US010844466B2

(12) United States Patent
Shiga et al.

(10) Patent No.: US 10,844,466 B2
(45) Date of Patent: Nov. 24, 2020

(54) HOT FORGING STEEL AND HOT FORGED PRODUCT

(71) Applicant: NIPPON STEEL & SUMITOMO METAL CORPORATION, Tokyo (JP)

(72) Inventors: Akira Shiga, Hokkaido (JP); Suguru Yoshida, Hokkaido (JP); Manabu Kubota, Nishinomiya (JP); Hajime Hasegawa, Hokkaido (JP); Hideo Mizukami, Kashima (JP)

(73) Assignee: NIPPON STEEL CORPORATION, Tokyo (JP)

( * ) Notice: Subject to any disclaimer, the term of this patent is extended or adjusted under 35 U.S.C. 154(b) by 218 days.

(21) Appl. No.: 15/767,042

(22) PCT Filed: Sep. 30, 2016

(86) PCT No.: PCT/JP2016/079052
§ 371 (c)(1),
(2) Date: Apr. 9, 2018

(87) PCT Pub. No.: WO2017/068935
PCT Pub. Date: Apr. 27, 2017

(65) Prior Publication Data

US 2018/0291486 A1 Oct. 11, 2018

(30) Foreign Application Priority Data

Oct. 19, 2015 (JP) ..... 2015-205630
Dec. 25, 2015 (JP) ..... 2015-254775

(51) Int. Cl.

| | |
|---|---|
| ***C22C 38/60*** | (2006.01) |
| ***C21D 9/30*** | (2006.01) |
| ***C22C 38/00*** | (2006.01) |
| ***B22D 11/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/28*** | (2006.01) |
| ***C22C 38/38*** | (2006.01) |
| *C21D 8/06* | (2006.01) |

(52) U.S. Cl.
CPC ..... *C22C 38/60* (2013.01); *B22D 11/001* (2013.01); *C21D 9/30* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/24* (2013.01); *C22C 38/28* (2013.01); *C22C 38/38* (2013.01); *C21D 8/065* (2013.01); *C21D 2211/004* (2013.01)

(58) Field of Classification Search
CPC ..... B22D 11/001; C21D 2211/004; C21D 8/065; C21D 9/30; C22C 38/00; C22C 38/001; C22C 38/002; C22C 38/02; C22C 38/04; C22C 38/06; C22C 38/24; C22C 38/28; C22C 38/38; C22C 38/60
See application file for complete search history.

(56) References Cited

U.S. PATENT DOCUMENTS

| | | | | |
|---|---|---|---|---|
| 2009/0183802 | A1 | 7/2009 | Deura et al. | |
| 2013/0213199 | A1* | 8/2013 | Aiso | B23Q 11/1007 83/22 |
| 2017/0067140 | A1 | 3/2017 | Aiso et al. | |
| 2018/0057917 | A1* | 3/2018 | Matsui | C21D 8/06 |

FOREIGN PATENT DOCUMENTS

| | | | |
|---|---|---|---|
| CN | 101492789 | A | 7/2009 |
| CN | 104120371 | A | 10/2014 |
| EP | 1069191 | A1 | 1/2001 |
| EP | 2816131 | A1 | 12/2014 |
| JP | 2-228447 | A | 9/1990 |
| JP | 10-296396 | A | 11/1998 |
| JP | 2000-319751 | A | 11/2000 |
| JP | 2003-293081 | A | 10/2003 |
| JP | 2003-301238 | A | 10/2003 |
| JP | 3893756 | B2 | 3/2007 |
| JP | 2012-35286 | A | 2/2012 |

(Continued)

OTHER PUBLICATIONS

Extended European Search Report for counterpart European Application No. 16857251.9, dated May 13 2019.
Kodym et al., "Spurenelemente im Stahl—Moeglichkeiten zur Beeinflussung im Schmelzbetrieb", Spurenelemente in Staehlen, Verlag Stahleisen, Duesseldorf, DE, Jan. 1, 1985, pp. 19-22 with abstract.
International Search Report for PCT/JP2016/079052 (PCT/ISA/210) dated Dec. 20, 2016.
Isobe et al., Analysis about behavior of formation of MnS during solidification of resulphurized free cutting steel, Journal of the Iron & Steel Institute of Japan, 1986.09, vol. 72, No. 12, S1065, p. 273.
Shao et al., "Morphology Evolution of MnS inclusions in Hot Forging Steel by Heat Treatment", Current advances in materials and processes, Mar. 1, 2011, vol. 24, No. 1, pp. 521-524.

(Continued)

*Primary Examiner* — Jenny R Wu
(74) *Attorney, Agent, or Firm* — Birch, Stewart, Kolasch & Birch, LLP

(57) ABSTRACT

There is provided a hot forging steel including, by mass %, C: more than 0.30% and less than 0.60%, Si: 0.10% to 0.90%, Mn: 0.50% to 2.00%, S: 0.010% to 0.100%, Cr: 0.01% to 1.00%, Al: more than 0.005% and 0.100% or less, N: 0.0030% to 0.0200%, Bi: more than 0.0001% and 0.0050% or less, Ti: 0% or more and less than 0.040%, V: 0% to 0.30%, Ca: 0% to 0.0040%, Pb: 0% to 0.40%, and a remainder including Fe and impurities, in which P and O in the impurities are respectively P: 0.050% or less and O: 0.0050% or less, an expression $d+3\sigma<20$ is satisfied, and a presence density of MnS having an equivalent circle diameter of smaller than 2.0 μm is 300 pieces/mm$^2$ or more in a cross section parallel to a rolling direction of a steel.

18 Claims, No Drawings

(56) References Cited

FOREIGN PATENT DOCUMENTS

| | | | | |
|---|---|---|---|---|
| JP | 5545273 | B2 | 7/2014 | |
| JP | 2015-7278 | A | 1/2015 | |
| WO | WO-2013121930 | A1 * | 8/2013 | ..... C22C 38/22 |
| WO | WO 2015/125915 | A1 | 8/2015 | |

OTHER PUBLICATIONS

Written Opinion of the International Searching Authority for PCT/JP2016/079052 (PCT/ISA/237) dated Dec. 20, 2016.

Chinese Office Action and Search Report dated Jul. 10, 2019 for counterpart Chinese Application No. 201680060712.X, with English translation of the Search Report.

Japanese Office Action dated Jan. 29, 2019, issued in Japanese Patent Application 2017-546476.

* cited by examiner

HOT FORGING STEEL AND HOT FORGED PRODUCT

TECHNICAL FIELD OF THE INVENTION

The present invention relates to a hot forging steel and a hot forged product. Priority is claimed on Japanese Patent Application No. 2015-205630, filed on Oct. 19, 2015, and Japanese Patent Application No. 2015-254775, filed on Dec. 25, 2015, the contents of which are incorporated herein by reference.

RELATED ART

Hot forged products are utilized as machine components of industrial machinery, construction machinery, and transportation machinery represented by automobiles. Examples of machine components include engine components and crankshafts.

A hot forged product is manufactured through the following process.

First, an intermediate product is manufactured by performing hot forging of a hot forging steel. As necessary, quench and temper treatment is executed with respect to the manufactured intermediate product. Cutting, piercing, or the like is performed with respect to the rolled or normalized intermediate product without any change after hot forging or the intermediate product after quench and temper treatment such that the intermediate product is machined into a component shape. Surface-hardening treatment such as induction hardening, carburizing, and nitriding is executed with respect to the machined intermediate product. After surface-hardening treatment, finishing such as grinding and polishing is executed with respect to the intermediate product, and a hot forged product is then manufactured.

Machining such as cutting and piercing is executed with respect to the hot forged product in a state of the intermediate product. Therefore, the hot forging steel requires excellent machinability. It is widely known that if a steel contains sulphur (S), S forms sulfide (for example, MnS) in the steel, and machinability of the steel is improved due to the MnS.

Incidentally, as described above, surface-hardening treatment (induction hardening, carburizing, nitriding, and the like) is executed with respect to a hot forged product. In surface-hardening treatment, induction hardening can harden a surface of a steel in a short period of time, compared to carburizing or nitriding. However, there are cases where a quenching crack occurs in a hot forged product to which induction hardening is executed. In addition, there are also cases where a grinding crack occurs when finishing is executed with respect to an intermediate product after induction hardening. Therefore, generally, a magnetic particle testing is executed with respect to a hot forged product to which induction hardening has been executed, and the presence or absence of a surface defect such as a quenching crack and a grinding crack is checked.

Generally, in the magnetic particle testing, a magnetic leakage flux is generated in a surface defect part of a hot forged product by magnetizing the hot forged product, and a magnetic particle pattern is formed by causing magnetic particle to be adsorbed to a place where a significant magnetic leakage flux is generated. From this magnetic particle pattern, it is possible to specify the presence or absence of occurrence of a defect, and the occurrence location of a surface defect. However, when the S content is increased in order to improve machinability, there are cases where a false pattern caused by MnS is generated in the magnetic particle testing. The reason is that although MnS is formed when the S content is increased, since MnS is a non-magnetic element, a magnetic leakage flux is generated due to the MnS so that a false pattern caused by MnS is formed.

As described above, a false pattern is a magnetic particle pattern which is formed due to a factor other than a surface defect during the magnetic particle testing. Therefore, there are cases where a hot forged product is mistaken for having a surface defect due to a false pattern caused by MnS. In order to prevent such a mistake, when a penetrant testing is executed with respect to a hot forged product in which a magnetic particle pattern is generated, the presence or absence of a surface defect can be precisely checked. However, an inspection workload increases due to the penetrant testing executed in addition to the magnetic particle testing.

In regard to improvement of machinability, for example, Patent Documents 1 and 2 disclose a steel for machine structural use containing a predetermined number or more of sulfide-based inclusions having MnS as a main composition in a steel. However, in Patent Documents 1 and 2, there is no consideration for restraining a false pattern. Furthermore, in the technology of Patent Documents 1 and 2, there is a need for Mn/S to range from 0.6 to 1.4 by atom % ratio. In this case, since the S content increases, there is concern that hot ductility is degraded due to formed FeS and a crack occurs.

In regard to the problem described above, for example, Patent Documents 3 and 4 have proposed a technology in which machinability is maintained and a false pattern is restrained from being generated.

Patent Document 3 discloses that carbon sulfide caused by TiS is formed in a steel in place of MnS by containing Ti and decreasing the N content. According to Patent Document 3, it is disclosed that when this carbon sulfide is dispersed, machinability is maintained and a false pattern is restrained from being generated.

Patent Document 4 discloses that Ca and Te are contained in a steel while having a condition of Ca/Te<1.0. According to Patent Document 4, it is disclosed that when Ca and Te are solid-solubilized in MnS in a steel and spheroidized MnS is formed, machinability is maintained and a false pattern is restrained from being generated.

However, in the hot forging steel disclosed in Patent Document 3, there is a need for the Ti content to be high such as 0.04% or more. Therefore, depending on conditions of hot forging, there are cases where hardness of a steel becomes excessively high and machinability is degraded.

In the hot forging steel disclosed in Patent Document 4, MnS is spheroidized by containing Ca and Te, and MnS is divided and refined by causing a rolling reduction of hot working to be 6.0 or greater, so that a false pattern is restrained from being generated. A rolling reduction is indicated by cross-sectional area ($mm^2$) of slab or ingot/cross-sectional area ($mm^2$) of steel bar.

However, in a large-sized hot forged product in which the size of a slab is small and the size of a steel bar is large, since the rolling reduction cannot be increased, there is concern that coarse MnS remains. Even in a case where the rolling reduction is small, in order to refine MnS, there is a need to refine MnS as much as possible in a stage of a slab before hot rolling.

PRIOR ART DOCUMENT

Patent Document

[Patent Document 1] Japanese Unexamined Patent Application, First Publication No. 2003-293081

[Patent Document 2] Japanese Unexamined Patent Application, First Publication No. 2003-301238

[Patent Document 3] Japanese Patent No. 3893756

[Patent Document 4] Japanese Patent No. 5545273

DISCLOSURE OF THE INVENTION

Problems to be Solved by the Invention

The present invention has been made in consideration of the foregoing problems, and an object thereof is to provide a hot forging steel and a hot forged product which have excellent machinability after hot forging and in which a false pattern is unlikely to be generated at the time of a magnetic particle testing.

Means for Solving the Problem (1) According to an aspect of the present invention, there is provided a hot forging steel including, by mass %, C: more than 0.30% and less than 0.60%, Si: 0.10% to 0.90%, Mn: 0.50% to 2.00%, S: 0.010% to 0.100%, Cr: 0.01% to 1.00%, Al: more than 0.005% and 0.100% or less, N: 0.0030% to 0.0200%, Bi: more than 0.0001% and 0.0050% or less, Ti: 0% or more and less than 0.040%, V: 0% to 0.30%, Ca: 0% to 0.0040%, Pb: 0% to 0.40%, and a remainder including Fe and impurities, in which P and O in the impurities are respectively P: 0.050% or less, and O: 0.0050% or less, a following Expression (a) is satisfied, and a presence density of MnS having an equivalent circle diameter of smaller than 2.0 μm is 300 pieces/mm$^2$ or more in a cross section parallel to a rolling direction of a steel.

$$d+3\sigma<20 \quad \text{(a)}$$

Here, d in the Expression (a) represents an average equivalent circle diameter of the MnS in an unit of μm having the equivalent circle diameter of 1.0 μm or greater, and σ in the Expression (a) represents a standard deviation of the equivalent circle diameter of the MnS having the equivalent circle diameter of 1.0 μm or greater.

(2) The hot forging steel according to (1) may include, by mass %, Ti: 0.001% or more and less than 0.040%.

(3) The hot forging steel according to (1) or (2) may include, by mass %, V: 0.03% to 0.30%.

(4) The hot forging steel according to any one of (1) to (3) may include, by mass %, one or more selected from the group consisting of Ca: 0.0003% to 0.0040% and Pb: 0.05% to 0.40% may be contained.

(5) The hot forging steel according to any one of (1) to (4) may include, by mass %, P: 0.020% or less.

(6) According to another aspect of the present invention, there is provided a hot forged product including, by mass %, C: more than 0.30% and less than 0.60%, Si: 0.10% to 0.90%, Mn: 0.50% to 2.00%, S: 0.010% to 0.100%, Cr: 0.01% to 1.00%, Al: more than 0.005% and 0.100% or less, N: 0.0030% to 0.0200%, Bi: more than 0.0001% and 0.0050% or less, Ti: 0% or more and less than 0.040%, V: 0% to 0.30%, Ca: 0% to 0.0040%, Pb: 0% to 0.40%, and a remainder including Fe and impurities, in which P and O in the impurities are respectively P: 0.050% or less, and O: 0.0050% or less, a following Expression (b) is satisfied, and a presence density of MnS having an equivalent circle diameter of smaller than 2.0 μm is 300 pieces/mm$^2$ or more in a cross section parallel to a rolling direction of a steel.

$$d+3\sigma<20 \quad \text{(b)}$$

Here, d in the Expression (b) represents an average equivalent circle diameter of the MnS in an unit of μm having the equivalent circle diameter of 1.0 μm or greater, and σ in the Expression (b) represents a standard deviation of the equivalent circle diameter of the MnS having the equivalent circle diameter of 1.0 μm or greater.

(7) The hot forged product according to (6) may include, by mass %, Ti: 0.001% or more and less than 0.040%.

(8) The hot forged product according to (6) or (7) may include, by mass %, V: 0.03% to 0.30%.

(9) The hot forged product according to any one of (6) to (8) may include, by mass %, one or more selected from the group consisting of Ca: 0.0003% to 0.0040% and Pb: 0.05% to 0.40%.

(10) The hot forged product according to any one of (6) to (9) may include, by mass %, P: 0.020% or less.

Effects of the Invention

According to the aspects of the present invention, it is possible to provide a hot forging steel and a hot forged product which have excellent machinability after hot forging and in which a false pattern is unlikely to be generated at the time of a magnetic particle testing.

EMBODIMENTS OF THE INVENTION

The inventors have investigated and examined hot forging steels and have consequently achieved the following knowledge.

(a) When the S content in a steel is reduced, MnS is reduced, and a false pattern at the time of a magnetic particle testing is restrained from being generated. However, when MnS is reduced, machinability of a steel is degraded. That is, restraining a false pattern from being generated and improving machinability are in a relationship of being contrary to each other.

(b) In order to improve machinability without increasing the S content, controlling the size and distribution of MnS is important.

(c) As a result of various experiments performed regarding a relationship between an equivalent circle diameter of sulfide and a wear amount of a tool, in a cross section parallel to a rolling direction of a steel, when MnS having an equivalent circle diameter of smaller than 2.0 μm is present in a steel by the presence density of 300 pieces/mm$^2$ or more, wear of a tool is suppressed.

(d) Meanwhile, in the magnetic particle testing, magnetic particle is adsorbed to a place where a significant magnetic leakage flux is generated, and a magnetic particle pattern is formed. Since MnS is a non-magnetic element, when the size of MnS in a surface layer of a steel increases, the magnetic leakage flux caused by MnS increases to the extent that a magnetic particle pattern can be formed. Meanwhile, when the size of MnS is small, the magnetic leakage flux caused by MnS is reduced, and a magnetic particle pattern is unlikely to be formed. Therefore, if MnS is refined, a false pattern is restrained from being generated.

(e) MnS in a steel is often crystallized before solidification (in a molten steel) or at the time of solidification, and the size of MnS is considerably affected by the cooling rate at the time of solidification. In addition, the solidification structure of a continuously cast slab generally exhibits a form of dendrite. This dendrite is formed due to diffusion of a solute element in a solidification process, and the solute element is concentrated in portions among the dendrite trees. Mn is concentrated in portions among trees, and MnS is crystallized among trees.

(f) In order for MnS to be finely dispersed, spacing among dendrite trees needs to be shortened.

In the related art, studies on primary arm spacing of dendrite have been conducted and can be expressed by the following Expression (A) (refer to the following reference literature).

$$\lambda \propto (D \times \sigma \times \Delta T)^{0.25} \quad (A)$$

Here, λ is primary arm spacing (μm) of dendrite, D is a diffusion coefficient ($m^2/s$), σ is solid-liquid interface energy ($J/m^2$), and ΔT is a solidification temperature range (° C.).

Reference literature: written by W. Kurz and D. J. Fisher, "Fundamentals of Solidification", Trans Tech Publications Ltd., (Switzerland), 1998, p. 256

From this Expression (A), it is found that the primary arm spacing λ of dendrite depends on the solid-liquid interface energy σ and λ is reduced if this factor σ can be reduced.

The inventors have found that when a minute amount of Bi is contained in a steel, the solid-liquid interface energy can be degraded and the dendrite structure can be refined, and if λ can be reduced, the size of MnS crystallized among dendrite trees can be refined.

Hereinafter, a hot forging steel according to an embodiment of the present invention (hot forging steel according to the present embodiment) and a hot forged product (hot forged product according to the present embodiment) will be described in detail.

First, the amount of each composition element will be described. Here, the percentage sign "%" regarding the composition indicates "mass %".

C: More than 0.30% and Less than 0.60%

Carbon (C) increases tensile strength and fatigue strength of a steel. In order to achieve this effect, the C content is set to more than 0.30% and is preferably set to 0.32% or more. Meanwhile, when the C content is excessive, machinability of a steel is degraded. Therefore, the C content is set to less than 0.60% and is preferably set to 0.55% or less.

Si: 0.10% to 0.90%

Silicon (Si) is solid-solubilized in ferrite in a steel and increases tensile strength of a steel. In order to achieve this effect, the Si content is set to 0.10% or more and is preferably set to 0.17% or more. Meanwhile, when the Si content is excessive, scale is likely to remain on a surface of a hot forged product and the external appearance of the hot forged product is impaired. Therefore, the Si content is set to 0.90% or less and is preferably set to 0.74% or less.

Mn: 0.50% to 2.00%

Manganese (Mn) is solid-solubilized in a steel such that tensile strength, fatigue strength, and hardenability of the steel increase. Furthermore, Mn combines with sulphur (S) in a steel and forms MnS such that machinability of the steel is enhanced. In order to achieve these effects, the Mn content is set to 0.50% or more. In a case of increasing tensile strength, fatigue strength, and hardenability of a steel, the Mn content is preferably set to 0.60% or more and is more preferably set to 0.75% or more. Meanwhile, if the Mn content is excessive, machinability of a steel is degraded. Therefore, the Mn content is set to 2.00% or less. In a case of further increasing machinability of a steel, the Mn content is preferably set to 1.90% or less and is more preferably set to 1.70% or less.

S: 0.010% to 0.100%

Sulphur (S) combines with Mn in a steel and forms MnS such that machinability of the steel is enhanced. In order to achieve this effect, the S content is set to 0.010% or more. In a case of enhancing machinability of a steel, the lower limit of the S content is preferably set to 0.015% and is more preferably set to 0.020%. Meanwhile, when the S content is excessive, fatigue strength of a steel is degraded. Furthermore, in a case of executing a magnetic particle testing with respect to a hot forged product after induction hardening, a false pattern is likely to be generated on a surface of the hot forged product. Therefore, the S content is set to 0.100% or less. The upper limit of the S content is preferably set to 0.090% and is more preferably set to 0.080%.

Cr: 0.01% to 1.00%

Chromium (Cr) increases hardenability and tensile strength of a steel. In addition, Cr increases hardenability of a steel and increases surface hardness of a steel after carburizing treatment or induction hardening. In order to achieve these effects, the Cr content is preferably set to 0.01% or more. In a case of increasing hardenability and tensile strength of a steel, the Cr content is preferably set to 0.03% or more and is more preferably set to 0.10% or more. Meanwhile, when the Cr content is excessive, machinability of a steel is degraded. Therefore, the Cr content is set to 1.00% or less. In order to suppress degradation of machinability, the Cr content is preferably set to 0.70% or less and is more preferably set to 0.50% or less.

Al: More than 0.005% and 0.100% or Less

Aluminum (Al) not only has deoxidizing action, but also combines with N and forms AlN. Thus, Al is an element effective in preventing coarsening of austenite grains at the time of carburizing heating. However, when the Al content is 0.005% or less, coarsening of the austenite grain cannot be stably prevented. In a case where austenite grains are coarsened, bending fatigue strength is degraded. Therefore, the Al content is set to more than 0.005% and is preferably set to 0.030% or more. Meanwhile, when the Al content exceeds 0.100%, coarse oxide is likely to be formed and bending fatigue strength is degraded. Therefore, the Al content is set to 0.100% or less and is preferably set to 0.060% or less.

N: 0.0030% to 0.0200%

Nitrogen (N) is an element forming nitride or carbonitride when being contained together with Ti or Nb, such that austenite grains are refined and fatigue strength of a steel increases. In order to achieve this effect, the N content is set to 0.0030% or more and is preferably set to 0.0050% or more. Meanwhile, when the N content is excessive, nitride in a steel is coarsened and machinability of a steel is degraded. Therefore, the N content is set to 0.0200% or less and is preferably set to 0.0180% or less.

Bi: More than 0.0001% and 0.0050% or Less

Bismuth (Bi) is an important element for the hot forging steel according to the present embodiment. In the related art, it has been considered that even though Bi is contained, Bi does not contribute to improvement of machinability if the amount is minute. However, in the hot forging steel according to the present embodiment, the solidification structure of a steel is refined by containing a minute amount of Bi. Accordingly, MnS is finely dispersed. As a result, the wear amount of a cutting tool is reduced. That is, machinability is improved. In order to achieve the effect of refining MnS, the Bi content needs to be set to more than 0.0001%. Furthermore, in order to increase the effect of finely dispersing MnS and to improve machinability, the Bi content is preferably set to 0.0010% or more. Meanwhile, when the Bi content exceeds 0.0050%, the effect of refining the dendrite structure is saturated and hot workability of a steel deteriorates, so that it is difficult to perform hot rolling. Therefore, the Bi content is set to 0.0050% or less. From a viewpoint of preventing defects caused due to degradation of hot workability, the Bi content is preferably set to 0.0040% or less.

P: 0.050% or Less

Phosphorus (P) is impurities and is an element degrading fatigue strength or hot workability of a steel. Therefore, the smaller the P content, the more preferable. When the P content exceeds 0.050%, the adverse influence described above becomes prominent. Therefore, the P content is set to 0.050% or less. The P content is preferably set to 0.020% or less, is more preferably set to 0.018% or less, and is still more preferably set to 0.015% or less.

O: 0.0050% or Less

Oxygen (O) is an impurity element and is an element which combines with Al, forms full hard oxide-based inclusions, and degrades bending fatigue strength. Particularly, when the O content exceeds 0.0050%, fatigue strength is remarkably degraded. Therefore, the O content is set to 0.0050% or less. The O content is preferably set to 0.0010% or less. It is more preferable that O is reduced as much as possible within a range not causing a cost rise in a steelmaking process.

Basically, the remainder in the chemical composition of the hot forging steel according to the present embodiment includes Fe and impurities. However, in place of a part of Fe, selective elements described below may be included.

The impurities mentioned herein denote elements incorporated due to ores or scrap utilized as raw materials of a steel, or due to the environment and the like of a manufacturing process.

[Selective Element]

Furthermore, in place of a part of Fe, the hot forging steel according to the present embodiment may contain at least one selected from the group consisting of Ti, V, Ca, and Pb. However, these selective elements are not necessarily contained, and their lower limits are 0%.

Ti: 0% or More and Less than 0.040%

Titanium (Ti) is an element forming nitride or carbonitride. Nitride and carbonitride refine austenite grains and increase fatigue strength of a steel. In a case of increasing fatigue strength, the Ti content is preferably set to 0.001% or more and is more preferably set to 0.005% or more. Meanwhile, if the Ti content is excessive, machinability of a steel is degraded. In addition, when the Ti content is 0.040% or more, there is concern that $Ti_4C_2S_2$ is formed and sufficient pieces of MnS are not formed. Therefore, even in a case of being contained, the Ti content is set to less than 0.040% and is preferably set to 0.020% or less.

V: 0% to 0.30%

Vanadium (V) is an element forming carbide in a steel and increasing fatigue strength of a steel. Vanadium carbide is precipitated in ferrite and increases strength of a core portion (part other than the surface layer) of a steel. Even if the V content is minute, the effect described above can be achieved. If the V content is 0.03% or more, the effect described above can be achieved prominently, which is preferable. The V content is more preferably set to 0.04% or more and is still more preferably set to 0.05% or more. Meanwhile, when the V content is excessive, machinability and fatigue strength of a steel are degraded. Therefore, even in a case of being contained, the V content is set to 0.30% or less. The V content is preferably set to 0.20% or less and is more preferably set to 0.10% or less.

Ca: 0% to 0.0040%

Calcium (Ca) is an element which is solid-solubilized in MnS and causes MnS-based inclusions to be spheroidized, such that the MnS-based inclusions are refined. When the MnS-based inclusions are refined, a false pattern is restrained from being generated in the magnetic particle testing. In a case where this effect is to be achieved, the Ca content is preferably set to 0.0003% or more. Meanwhile, if the Ca content is excessive, coarse oxide is formed. The coarse oxide degrades machinability of a steel. Therefore, even in a case of being contained, the Ca content is set to 0.0040% or less and is preferably set to 0.0035% or less.

Pb: 0% to 0.40%

Lead (Pb) is an element enhancing machinability of a steel. Even if the Pb content is minute, the effect described above can be achieved. However, in a case where a sufficient effect is to be achieved, the Pb content is preferably set to 0.05% or more. Meanwhile, if the Pb content is excessive, toughness and hot ductility of a steel are degraded. Therefore, even in a case of being contained, the Pb content is set to 0.40% or less and is preferably set to 0.25% or less.

As described above, the hot forging steel according to the present embodiment has a chemical composition which includes the basic elements described above and the remainder including Fe and impurities, or a chemical composition which includes the basic elements described above, one or more selected from the group consisting of the selective elements described above, and the remainder including Fe and impurities.

Depending on hot forging or heat treatment performed to obtain a hot forged product from a hot forging steel, the chemical composition does not change. Therefore, the chemical composition of the hot forging steel according to the present embodiment and the chemical composition of the hot forged product according to the present embodiment obtained while having the hot forging steel according to the present embodiment as a material are the same as each other.

Next, MnS included in metallographic structures of the hot forging steel and the hot forged product according to the present embodiment will be described.

[MnS]

MnS is useful for improving machinability, and its number density needs to be ensured to a certain degree or higher. However, when the S content increases, machinability is improved. On the other hand, coarse MnS increases. Coarse MnS is detected as a false pattern at the time of detecting a magnetic particle flaw. Therefore, in order to improve machinability, the number of pieces and the size of MnS need to be controlled. Specifically, in a cross section parallel to the rolling direction of a steel, when MnS having an equivalent circle diameter of smaller than 2.0 μm is present in a steel by the presence density (number density) of 300 pieces/$mm^2$ or more, wear of a tool is suppressed. Although there is no need to regulate the upper limit of the number density of MnS having an equivalent circle diameter of smaller than 2.0 μm, it is considered that the number density of MnS does not become more than 700 pieces/$mm^2$ in this chemical composition.

MnS as inclusions may be checked through an energy dispersive X-ray spectroscopic analysis belonging to an electronic scanning microscope. In addition, the equivalent circle diameter of MnS is a diameter of a circle having an area equal to the area of MnS and can be obtained through an image analysis as described above. Similarly, the number density of MnS can be obtained through an image analysis.

Specifically, the equivalent circle diameter and the number density of MnS are obtained by the following method. That is, the metallographic structure of a hot forging steel in a cross section parallel to the longitudinal direction (axial direction) of the steel is observed using an optical microscope, and precipitates are discriminated based on the contrast in the structure. It is possible to check that the precipitates are MnS by using an electronic scanning microscope and an energy dispersive X-ray spectroscopic analysis apparatus (EDS). In addition, as many images of an inspection reference area (region) of 0.9 $mm^2$ are prepared as ten visions by photo-capturing the same cross section as the cross section in which the precipitates of a test piece are discriminated, at a magnification of 100-fold using an optical microscope. Among pieces of MnS in the observation visions (images), ten pieces are selected in descending order of size, and the dimension of each of the selected MnS is obtained by converting the dimension thereof into an equivalent circle diameter indicating the diameter of a circle having the same area as the area of the precipitates. In addition, the average equivalent circle diameter and the standard deviation of sulfide are calculated from the grain size distribution of detected MnS.

If the primary arm spacing of dendrite is reduced in the solidification structure of a continuously cast slab, the percentage of fine sulfide crystallized from among dendrite trees can be increased. If MnS of 20 μm or greater at the maximum circle equivalent diameter is removed by refining sulfide, a false pattern can be restrained from being generated. The inventors have calculated unevenness of the equivalent circle diameter of sulfide detected per 9 $mm^2$ in the observation vision as the standard deviation σ, and have defined the value obtained by adding an average equivalent circle diameter d of sulfide detected per 9 $mm^2$ in the observation vision to 3σ of this standard deviation, as F1.

$$F1=d+3\sigma \quad (c)$$

Here, d in Expression (c) is the average equivalent circle diameter (μm) of MnS having an equivalent circle diameter of 1.0 μm or greater, and σ is the standard deviation of the equivalent circle diameter of MnS having an equivalent circle diameter of 1.0 μm or greater.

The value of F1 indicates the maximum circle equivalent diameter in 99.7% of pieces of sulfide among the pieces of sulfide which are present in the hot forging steel according to the present embodiment and can be observed using an optical microscope. The maximum circle equivalent diameter is estimated from the equivalent circle diameter of sulfide observed within the range of the observation vision by 9 $mm^2$, and the standard deviation of the equivalent circle diameter. That is, if the value F1 is less than 20 (μm), it indicates that little sulfide of 20 μm or greater at the maximum circle equivalent diameter is present in a hot forging steel. In such a steel, a false pattern can be restrained from being generated. The equivalent circle diameter of MnS is a diameter of a circle having an area equal to the area of the MnS and can be obtained through an image analysis as described above. The equivalent circle diameter of MnS as an observation target is set to 1.0 μm or greater because the size and the composition of particles can be statistically handled using a general-purpose instrument realistically, and because hot forgeability and chip disposability are less affected even when sulfide smaller than that is controlled.

[Dendrite Structure of Slab]

As described above, generally, the solidification structure of a continuously cast slab exhibits a form of dendrite. MnS in a steel is often crystallized before being solidified (in a molten steel) or at the time of solidification and is considerably affected by the primary arm spacing of dendrite. That is, if the primary arm spacing of dendrite is small, MnS crystallized among trees thereof becomes small. In the hot forging steel according to the present embodiment, it is desirable that the primary arm spacing of dendrite in the stage of a slab is smaller than 600 μm.

In order to finely disperse MnS in a stable and effective manner, it is effective to contain a minute amount of Bi and to reduce the solid-liquid interface energy in a molten steel. When the solid-liquid interface energy is reduced, the dendrite structure is refined. When the dendrite structure is refined, MnS crystallized from dendrite primary arms is refined.

The dendrite structure of a slab is not observed in a hot forging steel. However, it is possible to check whether or not the primary arm spacing is less than 600 μm in the stage of a slab, for example, by etching a cross section of a sample gathered from a slab before hot working with picric acid, and directly observing the dendrite structure at a position in the depth of 15 mm from a slab surface.

[Manufacturing Method]

Next, a manufacturing method for the hot forging steel according to the present embodiment will be described. In the present embodiment, as an example, a process preferable for manufacturing a hot forging steel and a hot forged product including the hot forging steel (hot forged product obtained while having the hot forging steel as a material) will be described. For example, the hot forged product is a machine component utilized for automobiles and construction machinery, for example, an engine component represented by a crankshaft.

The hot forging steel according to the present embodiment has the chemical composition described above and is manufactured by continuously casting a slab in which the primary arm spacing of dendrite within a range of 15 mm from the surface layer is less than 600 μm, performing hot working of this slab, and further performing annealing, as necessary. Hot working may include hot rolling.

[Casting Process]

A slab of steel satisfying the chemical composition described above and $d+3\sigma<20$ is manufactured through a continuous casting method. An ingot (steel ingot) may be formed through an ingot-making method. Examples of casting conditions can include a condition in which superheating for a molten steel inside a tundish ranges from 10° C. to 50° C. and the casting speed is set to range from 1.0 to 1.5 m/min, using a mold of 220×220 mm square.

Furthermore, in order to cause the primary arm spacing of dendrite described above to be smaller than 600 μm, it is desirable that when a molten steel having the chemical composition described above is cast, the average cooling rate within a temperature range from the liquidus temperature to the solidus temperature in the depth of 15 mm from a slab surface ranges from 100° C./min to 500° C./min. The average cooling rate preferably ranges from 120° C./min to 500° C./min. When the average cooling rate is slower than 100° C./min, it is difficult to cause the primary arm spacing of dendrite at a position in the depth of 15 mm from a slab surface to be smaller than 600 μm, and there is concern that MnS cannot be finely dispersed. In a case where MnS cannot be finely dispersed, the number density of MnS is also reduced. Meanwhile, when the average cooling rate exceeds 500° C./min, MnS crystallized from among dendrite trees is excessively refined, and there is concern that machinability is degraded.

In addition, in order to reduce center segregation, reduction may be added in a stage in the middle of solidification of continuous casting.

The temperature range from the liquidus temperature to the solidus temperature indicates a temperature range from a start of solidification to an end of solidification. Therefore, the average cooling rate in this temperature range denotes the average solidification rate of a slab. The average cooling rate can be achieved by means of a technique, for example, controlling the cross-sectional size of the mold, the casting speed, and the like to proper values, or increasing the quantity of cooling water used for water cooling immediately after casting. This can apply to both the continuous casting method and the ingot-making method.

The average cooling rate at a position in the depth of 15 mm can be obtained from the average which is the arithmetical mean by etching a cross section of an obtained slab with picric acid, measuring 100 spots of secondary arm spacing $\lambda_2$ (μm) of dendrite at a pitch of 5 mm in a casting direction with respect to each of the positions in the depth of 15 mm from a slab surface, and calculating a cooling rate A (° C./sec) within the temperature range from the liquidus temperature to the solidus temperature of a slab from the values based on the following Expression (3).

$$\lambda_2=710\times A-0.39 \quad (3)$$

Therefore, for example, an optimal casting condition can be determined from obtained cooling rates by manufacturing a plurality of slabs under various casting conditions and obtaining the cooling rate of each slab by Expression (3).

[Hot Working Process and Annealing Process]

Subsequently, a billet (steel piece) is manufactured by performing hot working such as blooming with respect to a slab or an ingot obtained through the casting process. Furthermore, the billet is subjected to hot rolling, thereby obtaining a steel bar or a wire rod which is the hot forging steel according to the present embodiment, by performing annealing as necessary. There is no particular limit to the rolling reduction for hot working.

In regard to hot rolling, for example, after a billet is heated at a heating temperature ranging from 1,250° C. to 1,300° C. for 1.5 hours or longer, hot rolling is performed at a finishing temperature ranging from 900° C. to 1,100° C. After finish rolling is performed, the billet may be cooled until the temperature reaches room temperature under a condition in which the cooling rate meets that of air cooling or slower in the atmosphere. However, in order to enhance productivity, it is preferable that cooling is performed by means of a suitable technique such as air cooling, mist cooling, and water cooling at the point of time the temperature reaches 600° C. The heating temperature and the heating time respectively denote the average temperature inside a furnace and the in-furnace time. In addition, the finishing temperature of hot rolling denotes the surface temperature of a bar or a wire at a finish stand outlet in a mill having a plurality of stands. The cooling rate after finish rolling is performed indicates the cooling rate on a surface of a bar or a wire (steel bar or wire rod).

In order to enhance hot forgeability, it is preferable that annealing is additionally executed. As annealing, spheroidizing annealing may be executed under known conditions. Examples thereof include a condition in which a round bar is subjected to soaking using a heating furnace at 740° C. for 8 hours and the round bar is cooled to 650° C. at the cooling rate of 15° C./h after soaking.

According to the manufacturing method including these processes, a steel bar or a wire rod (hot forging steel) is manufactured.

Furthermore, a manufactured steel bar or wire rod (hot forging steel) is subjected to hot forging, and then an intermediate product having a rough shape is manufactured. Quench and temper treatment may be executed with respect to the intermediate product. Furthermore, the intermediate product is subjected to machining such that the intermediate product is formed into a predetermined shape. For example, machining is cutting or piercing.

Next, induction hardening is executed with respect to the intermediate product, and the surface of the intermediate product is hardened. Accordingly, a surface hardening layer is formed on a surface of the intermediate product. Induction hardening may be performed under a known condition. Then, finishing is executed with respect to the intermediate product which has been subjected to induction hardening. Finishing is grinding or polishing. According to the processes described above, the hot forged product according to the present embodiment is manufactured.

The hot forged product according to the present embodiment has the same chemical composition as that of the hot forging steel. Similar to that of the hot forging steel, the presence density of MnS having an equivalent circle diameter of smaller than 2.0 μm is 300 pieces/mm$^2$ or more, and the condition of $d+3\sigma<20$ (μm) is satisfied. However, since induction hardening is performed for a hot forged product, a surface hardening layer is provided.

Generally, the magnetic particle testing is executed with respect to a hot forged product. In the magnetic particle testing, a surface defect (a quenching crack, a grinding crack, or the like) of a hot forged product is detected by utilizing magnetic particle. In the magnetic particle testing, a hot forged product is magnetized. In this case, a magnetic leakage flux is generated in a defect part of the hot forged product. The magnetic particle is adsorbed to a place where a significant magnetic leakage flux is generated, thereby forming a magnetic particle pattern. Therefore, from the magnetic particle pattern, it is possible to specify the presence or absence of occurrence and the occurrence location of a defect.

If coarse MnS is present in a surface layer of a hot forging steel or a hot forged product, a significant magnetic leakage flux caused by MnS is generated and a false pattern is formed. However, in the hot forging steel or the hot forged product according to the present embodiment, the primary arm spacing of dendrite is reduced in the stage of a slab, and MnS is refined. When MnS is fine, a magnetic leakage flux is unlikely to be generated to the extent that a false pattern is formed. Therefore, a false pattern is restrained from being generated.

When a material (steel bar) is subjected to hot forging, MnS in the steel is refined in accordance with the forging ratio. However, many hot forged products have a complicated shape, so that the forging ratio is not uniform throughout the entire material. Therefore, a rarely forged part, that is, a part having an extremely small forging ratio takes place in the material subjected to hot forging. Even in such a part, in order to restrain a false pattern from being generated, the maximum circle equivalent diameter of MnS in the hot forging steel which will become a material needs to be smaller than 20 μm. In the hot forging steel according to the present embodiment, since the maximum circle equivalent diameter of MnS is smaller than 20 μm, machinability can be improved and a false pattern can be suppressed without depending on the working quantity of hot working.

As described above, in a case of being formed into a hot forged product, the hot forging steel according to the present embodiment has excellent machinability after hot forging, and a false pattern is unlikely to be generated at the time of the magnetic particle testing, regardless of the rolling reduction of hot working including hot forging.

EXAMPLES

Steels A to X and a to y each having the chemical composition indicated in Tables 1 and 2 were formed into ingots in a converter (270 ton), and slabs of 220×220 mm square were manufactured by executing continuous casting using a continuous casting machine. Reduction was added in a stage in the middle of solidification of continuous casting. In addition, in continuous casting of the slabs, the average cooling rate within a temperature range from the liquidus temperature to the solidus temperature at a position in the depth of 15 mm from the slab surface was variously changed in accordance with the "slab average cooling rate" in Tables 3 and 4 by changing the quantity of cooling water in a mold.

Subsequently, the manufactured slabs were inserted into a heating furnace and were heated at a heating temperature ranging from 1,250° C. to 1,300° C. for 10 hours or longer. Thereafter, blooming was performed, and billets were obtained. Before the slabs were subjected to blooming, the slabs were temporarily cooled to room temperature, and the test pieces for observing the structure were gathered.

Subsequently, the billets were heated at a heating temperature ranging from 1,250° C. to 1,300° C. for 1.5 hours or longer. Thereafter, hot rolling was performed at a finishing temperature ranging from 900° C. to 1,100° C., and round bars having a diameter of 90 mm were obtained. The round bars after hot rolling were subjected to air cooling to room temperature in the atmosphere. In this manner, hot forging steels of test No. 1 to 50 were manufactured.

The steels A to X indicated in Tables 1 and 2 are steels having the chemical composition regulated by the present invention. Meanwhile, the steels a to y are steels of Comparative Examples having a chemical composition beyond the conditions regulated by the present invention. The underlines of the numerical values in Tables 1 and 2 indicate that the values are beyond the range of the present invention.

Then, machinability of the manufactured steels and the presence or absence of a false pattern in the magnetic particle testing were investigated. However, since many defects had occurred in hot rolling, no evaluation was performed for the Test No. 38.

[Observation of Solidification Structure]

As the solidification structure, a cross section of each slab was etched with picric acid, and 100 spots of the primary arm spacing of dendrite were measured at a pitch of 5 mm in the casting direction at a position of 15 mm in the depth direction from the slab surface. Then, the average value thereof was obtained.

[Microstructure Test]

The microstructure of the round bar (hot forging steel) of each Test No. was observed. The round bar was cut at D/4 (D: diameter) parallel to the axial direction (longitudinal direction), and a test piece for observing the microstructure was gathered. The cut surface of the test piece was polished, the metallographic structure of the steel was observed using an optical microscope, and the precipitate was discriminated based on the contrast in the structure. The test surface is a cross section parallel to the longitudinal direction of the hot forging steel. It was checked that a part of the precipitates was MnS using an electronic scanning microscope and an energy dispersive X-ray spectroscopic analysis apparatus (EDS). In addition, ten polished test pieces having a height of 10 mm and a width of 10 mm were prepared from the same cross section. Predetermined positions of these polished test pieces were photo-captured at a magnification of 100-fold using an optical microscope, and as many images of an inspection reference area (region) of 0.9 $mm^2$ were prepared as ten visions. Among pieces of MnS in the observation visions (images), ten pieces were selected in descending order of size, and the equivalent circle diameter of each piece of the selected MnS was calculated. The dimension (diameter) was converted into an equivalent circle diameter indicating the diameter of a circle having the same area as the area of precipitates. From the grain size distribution of the detected MnS, the average equivalent circle diameter and the standard deviation of sulfide were calculated.

Tables 3 and 4 indicate the values F1 ($=d+3\sigma$) which are indexes of the maximum circle equivalent diameter of MnS. Here, marks * in Tables 3 and 4 denote that the conditions for the maximum circle equivalent diameter of MnS of the present invention are not satisfied.

Next, using the round bars (hot forging steels, excluding 38) of the Test Nos. 1 to 50, machinability and the presence or absence of occurrence of a false pattern at the time of the magnetic particle testing were investigated. The round bars of the Test Nos. 1 to 50 corresponded to the materials of the hot forged products. If the round bar as the material had high machinability and a false pattern was unlikely to be generated at the time of the magnetic particle testing, the hot forged product which was formed of the round bar subjected to hot forging and was subjected to air cooling after forging has ended naturally has excellent machinability, and a false pattern is unlikely to be generated at the time of the magnetic particle testing. Therefore, machinability of the round bars corresponding to the materials and the presence or absence of occurrence of a false pattern in the magnetic particle testing were investigated through the following the test method.

[Lathe Turning Test]

The steel bars (diameter of 90 mm) of the test examples 1 to 50 were subjected to peeling until the diameter becomes 85 mm, and lathe turning test pieces were obtained.

Lathe turning was executed using the manufactured test pieces. In lathe turning, a P-type super-hard tool according to the JIS standard was used. Coating treatment was not performed with respect to the super-hard tool. The cutting speed was set to 250 m/min, the feeding speed was set to 0.30 mm/rev, and a cut of 1.5 mm was made, thereby executing lathe turning without using lubricating oil. After the lapse of 10 minutes after the start of lathe turning, the wear amount (mm) of the flank of the super-hard tool was measured.

If the wear amount of the flank of the super-hard tool was 0.20 mm or smaller, it was determined to have excellent machinability.

[False Pattern Evaluation Test]

From central portions of the round bars of the test examples 1 to 50, the round bar test pieces having a diameter of 50 mm and a length of 100 mm were gathered. The axial direction of the round bar test piece was the same as the axial direction of each round bar. Induction hardening was executed with respect to the circumferential surface of the round bar test piece under the conditions of the frequency of 40 kHz, the voltage of 6 kV, and the heating time of 3.0 seconds. After induction hardening, tempering was executed with respect to the fatigue test piece. Specifically, the round bar test piece was heated at 150° C. for 1 hour. Thereafter, the round bar test piece was subjected to air cooling at the atmosphere. After tempering, the circumferential surface of the round bar test piece was subjected to finish polishing, and surface roughness was adjusted. Specifically, through finish polishing, the centerline average roughness (Ra) of the circumferential surface was set to be within 3.0 μm, and the maximum height (Rmax) was set to be within 9.0 μm. Penetrant testings according to JIS Z2343-1 (2001) were executed with respect to a plurality of round bar test pieces subjected to finish polishing, and 50 round bar test pieces having no defect were selected for each test example.

With respect to the 50 selected round bar test pieces, the magnetic particle testing was executed under the conditions described below.

<Test Conditions>

Magnetic particle: black magnetic particle

Concentration of magnetic particle: 1.8 ml (sedimentation volume of magnetic particle)/100 ml (unit volume)

Type of detection medium: wet-type

Application period of magnetic particle: continuous method

Magnetization method: axial energization method

Magnetization time: 5 seconds or longer

Magnetization current: AC

Current value: 2,500 A

With reference to Tables 1 to 4, in the steels of the Test Nos. 1 to 24, the chemical composition indicated in steels A to X was within the range of the chemical composition of the hot forging steel of the present invention, and the number density of MnS was 300 (pieces/mm$^2$) or higher. Furthermore, the condition for the value F1 (=d+3σ) to be less than 20 μm was satisfied. As a result, the Test Nos. 1 to 24 had excellent machinability, and no false pattern was generated.

The chemical composition of the Test No. 25 was within the range of the chemical composition of the hot forging steel of the present invention. However, the average cooling rate within the temperature range from the liquidus temperature to the solidus temperature at a position of the depth of 15 mm from the slab surface was slow, and the number density of MnS was reduced due to the widened primary arm spacing of dendrite. As a result, the wear amount of the flank exceeded 0.20 mm.

The Test Nos. 26 and 39 did not contain Bi. In addition, the S content was less than the range of the present invention. Therefore, the number density of MnS became less than 300 (pieces/mm$^2$), and the wear amount of the flank exceeded 0.20 mm.

The Test Nos. 27, 28, 40, and 41 did not contain Bi. Therefore, the value F1 became 20 μm or greater, and a false pattern was generated.

The Test Nos. 29 and 42 did not contain Bi. Therefore, the number density of MnS became less than 300 (pieces/mm$^2$), and the wear amount of the flank exceeded 0.20 mm.

The S contents in the Test Nos. 30, 31, 33, and 44 to 46 were less than the lower limit of the S content of the present invention. Therefore, the number density of MnS became less than 300 (pieces/mm$^2$), and the wear amount of the flank exceeded 0.20 mm.

The S contents in the Test Nos. 32 and 43 exceeded the upper limit of the S content of the present invention. Therefore, the value F1 was 20 μm or greater, and a false pattern was generated.

The C contents in the Test Nos. 34 and 47 exceeded the upper limit of the C content of the present invention. In addition, the Cr content of the Test No. 34 also exceeded the upper limit of the Cr content of the present invention. The Mn contents in the Test Nos. 35 and 48 exceeded the upper limit of the Mn content of the present invention. The Cr contents in the Test Nos. 36 and 49 exceeded the upper limit of the Cr content of the present invention. The Ti contents in the Test Nos. 37 and 50 exceeded the upper limit of the Ti content of the present invention. Therefore, the wear amounts of the flank of these Test Nos. exceeded 0.20 mm.

TABLE 1

| | Chemical composition (mass %) remainder: Fe and impurities | | | | | | | | | | | | | |
|---|---|---|---|---|---|---|---|---|---|---|---|---|---|---|
| Steel | C | Si | Mn | P | S | Cr | Al | Bi | Ti | V | Ca | Pb | N | O |
| A | 0.51 | 0.25 | 0.89 | 0.013 | 0.030 | 0.35 | 0.025 | 0.0031 | — | — | — | — | 0.0101 | 0.0011 |
| B | 0.45 | 0.80 | 0.55 | 0.013 | 0.035 | 0.95 | 0.038 | 0.0006 | — | — | — | — | 0.0112 | 0.0013 |
| C | 0.38 | 0.60 | 1.05 | 0.012 | 0.096 | 0.78 | 0.039 | 0.0049 | — | — | — | — | 0.0108 | 0.0012 |
| D | 0.44 | 0.70 | 1.20 | 0.014 | 0.012 | 0.40 | 0.018 | 0.0030 | — | 0.12 | — | — | 0.0087 | 0.0009 |
| E | 0.37 | 0.25 | 1.40 | 0.015 | 0.060 | 0.15 | 0.020 | 0.0025 | — | — | — | — | 0.0123 | 0.0009 |
| F | 0.47 | 0.85 | 0.78 | 0.018 | 0.035 | 0.11 | 0.035 | 0.0015 | — | 0.03 | — | 0.07 | 0.0062 | 0.0011 |
| G | 0.44 | 0.10 | 0.80 | 0.010 | 0.019 | 0.08 | 0.008 | 0.0021 | — | — | — | — | 0.0105 | 0.0009 |
| H | 0.33 | 0.60 | 1.97 | 0.014 | 0.090 | 0.20 | 0.038 | 0.0002 | — | 0.25 | — | — | 0.0120 | 0.0012 |
| I | 0.56 | 0.35 | 1.55 | 0.013 | 0.050 | 0.15 | 0.033 | 0.0040 | — | — | 0.0009 | — | 0.0098 | 0.0011 |
| J | 0.45 | 0.50 | 0.80 | 0.012 | 0.045 | 0.90 | 0.007 | 0.0039 | — | — | — | — | 0.0155 | 0.0010 |
| K | 0.49 | 0.30 | 1.80 | 0.013 | 0.030 | 0.15 | 0.020 | 0.0003 | — | 0.05 | 0.0030 | — | 0.0102 | 0.0018 |
| L | 0.53 | 0.15 | 0.60 | 0.011 | 0.098 | 0.40 | 0.038 | 0.0022 | — | — | — | — | 0.0140 | 0.0011 |
| M | 0.49 | 0.52 | 1.05 | 0.015 | 0.051 | 0.25 | 0.030 | 0.0030 | 0.005 | — | — | — | 0.0092 | 0.0010 |
| N | 0.55 | 0.58 | 1.50 | 0.011 | 0.010 | 0.84 | 0.032 | 0.0003 | 0.006 | — | — | — | 0.0125 | 0.0010 |
| 0 | 0.33 | 0.74 | 1.24 | 0.013 | 0.100 | 0.35 | 0.041 | 0.0048 | 0.014 | — | — | — | 0.0180 | 0.0009 |
| P | 0.42 | 0.64 | 0.97 | 0.015 | 0.011 | 0.41 | 0.022 | 0.0049 | 0.024 | 0.08 | — | — | 0.0145 | 0.0011 |
| Q | 0.35 | 0.38 | 0.64 | 0.019 | 0.050 | 0.15 | 0.031 | 0.0006 | 0.036 | — | — | — | 0.0096 | 0.0010 |
| R | 0.50 | 0.64 | 1.38 | 0.014 | 0.060 | 0.77 | 0.028 | 0.0015 | 0.005 | 0.05 | — | 0.100 | 0.0131 | 0.0018 |
| S | 0.41 | 0.88 | 1.67 | 0.013 | 0.022 | 0.61 | 0.033 | 0.0021 | 0.002 | — | — | — | 0.0114 | 0.0008 |
| T | 0.39 | 0.56 | 1.94 | 0.014 | 0.098 | 0.28 | 0.040 | 0.0002 | 0.014 | 0.11 | — | — | 0.0124 | 0.0011 |
| U | 0.45 | 0.27 | 1.45 | 0.015 | 0.055 | 0.39 | 0.035 | 0.0045 | 0.028 | — | 0.0010 | — | 0.0123 | 0.0008 |
| V | 0.52 | 0.65 | 1.34 | 0.015 | 0.085 | 0.84 | 0.031 | 0.0042 | 0.014 | — | — | — | 0.0142 | 0.0009 |
| W | 0.47 | 0.68 | 1.74 | 0.014 | 0.025 | 0.35 | 0.024 | 0.0040 | 0.024 | 0.04 | 0.0025 | — | 0.0117 | 0.0011 |
| X | 0.36 | 0.14 | 0.97 | 0.015 | 0.095 | 0.26 | 0.034 | 0.0020 | 0.007 | — | — | — | 0.0145 | 0.0009 |

The mark "_" indicates that the value is beyond the condition defined by the present invention The mark "—" indicates that no element is added.

TABLE 2

| Steel | Chemical composition (mass %) remainder: Fe and impurities | | | | | | | | | | | | | |
|---|---|---|---|---|---|---|---|---|---|---|---|---|---|---|
| | C | Si | Mn | P | S | Cr | Al | Bi | Ti | V | Ca | Pb | N | O |
| a | 0.53 | 0.30 | 1.40 | 0.013 | 0.008 | 0.15 | 0.030 | — | — | — | — | — | 0.0112 | 0.0010 |
| b | 0.53 | 0.18 | 1.21 | 0.015 | 0.070 | 0.20 | 0.028 | — | — | — | — | — | 0.0115 | 0.0013 |
| c | 0.45 | 0.53 | 0.85 | 0.015 | 0.022 | 0.25 | 0.035 | — | — | — | — | 0.05 | 0.0119 | 0.0012 |
| d | 0.36 | 0.74 | 0.85 | 0.013 | 0.015 | 0.60 | 0.031 | — | — | 0.15 | — | — | 0.0080 | 0.0019 |
| e | 0.45 | 0.25 | 1.30 | 0.012 | 0.007 | 0.15 | 0.025 | 0.0003 | — | — | — | 0.11 | 0.0094 | 0.0012 |
| f | 0.38 | 0.30 | 0.80 | 0.012 | 0.005 | 0.60 | 0.031 | 0.0015 | — | — | 0.0015 | — | 0.0110 | 0.0009 |
| g | 0.55 | 0.80 | 1.20 | 0.015 | 0.105 | 0.20 | 0.027 | 0.0020 | — | — | — | — | 0.0125 | 0.0016 |
| h | 0.45 | 0.30 | 0.65 | 0.011 | 0.008 | 1.20 | 0.031 | 0.0028 | — | 0.05 | — | — | 0.0088 | 0.0011 |
| i | 0.64 | 0.15 | 0.95 | 0.013 | 0.070 | 1.10 | 0.030 | 0.0035 | — | — | — | — | 0.0120 | 0.0012 |
| j | 0.40 | 0.20 | 2.05 | 0.015 | 0.012 | 0.30 | 0.028 | 0.0047 | — | — | — | — | 0.0109 | 0.0019 |
| k | 0.53 | 0.80 | 0.65 | 0.011 | 0.050 | 1.05 | 0.015 | 0.0027 | — | 0.05 | — | — | 0.0135 | 0.0012 |
| l | 0.55 | 0.35 | 1.20 | 0.010 | 0.045 | 0.35 | 0.014 | 0.0009 | 0.050 | — | — | — | 0.0110 | 0.0016 |
| m | 0.45 | 0.25 | 1.05 | 0.011 | 0.030 | 0.15 | 0.017 | 0.0060 | — | — | — | — | 0.0098 | 0.0011 |
| n | 0.54 | 0.39 | 1.45 | 0.014 | 0.002 | 0.20 | 0.026 | — | 0.011 | — | — | — | 0.0126 | 0.0012 |
| o | 0.47 | 0.51 | 1.32 | 0.013 | 0.095 | 0.15 | 0.035 | — | 0.014 | — | — | — | 0.0126 | 0.0010 |
| P | 0.36 | 0.87 | 0.98 | 0.014 | 0.051 | 0.33 | 0.031 | — | 0.011 | — | — | 0.18 | 0.0134 | 0.0011 |
| q | 0.49 | 0.74 | 1.47 | 0.015 | 0.015 | 0.50 | 0.036 | — | 0.008 | 0.10 | — | — | 0.0035 | 0.0023 |
| r | 0.42 | 0.82 | 1.54 | 0.015 | 0.115 | 0.22 | 0.034 | 0.0005 | 0.011 | — | — | 0.24 | 0.0094 | 0.0008 |
| s | 0.46 | 0.35 | 1.21 | 0.014 | 0.003 | 0.31 | 0.024 | 0.0003 | 0.009 | — | 0.0030 | — | 0.0126 | 0.0010 |
| t | 0.35 | 0.74 | 1.68 | 0.013 | 0.005 | 0.28 | 0.031 | 0.0026 | 0.021 | — | — | — | 0.0097 | 0.0018 |
| u | 0.55 | 0.41 | 0.54 | 0.015 | 0.006 | 0.11 | 0.035 | 0.0050 | 0.016 | 0.02 | — | — | 0.0125 | 0.0014 |
| v | 0.61 | 0.10 | 1.62 | 0.014 | 0.094 | 0.18 | 0.028 | 0.0031 | 0.012 | — | — | — | 0.0135 | 0.0016 |
| w | 0.35 | 0.64 | 2.24 | 0.013 | 0.067 | 0.30 | 0.033 | 0.0049 | 0.015 | — | — | — | 0.0142 | 0.0017 |
| x | 0.47 | 0.48 | 1.41 | 0.014 | 0.087 | 1.15 | 0.032 | 0.0036 | 0.014 | 0.03 | — | — | 0.0123 | 0.0016 |
| Y | 0.57 | 0.42 | 1.57 | 0.015 | 0.068 | 0.29 | 0.022 | 0.0047 | 0.049 | — | — | — | 0.0095 | 0.0015 |

The mark "_" indicates that the value is beyond the condition defined by the present invention.
The mark "–" indicates that no element is added.

TABLE 3

| Test No. | Steel | Average cooling rate of slab (°C./min) | Primary arm spacing of dendrite (μm) | Number density of MnS (pieces/mm$^2$) | d + 3σ (F1) (μm) | Number of occurrence of false pattern (number of occurrence/total number) | Wear amount of flank (mm) | Remarks |
|---|---|---|---|---|---|---|---|---|
| 1 | A | 380 | 429 | 382 | 11 | 0/50 | 0.16 | Examples |
| 2 | B | 390 | 582 | 386 | 13 | 0/50 | 0.20 | |
| 3 | C | 340 | 316 | 597 | 18 | 0/50 | 0.13 | |
| 4 | D | 300 | 422 | 311 | 8 | 0/50 | 0.18 | |
| 5 | E | 295 | 451 | 477 | 12 | 0/50 | 0.18 | |
| 6 | F | 325 | 532 | 385 | 12 | 0/50 | 0.18 | |
| 7 | G | 270 | 469 | 317 | 11 | 0/50 | 0.16 | |
| 8 | H | 320 | 590 | 549 | 19 | 0/50 | 0.20 | |
| 9 | I | 340 | 370 | 461 | 14 | 0/50 | 0.14 | |
| 10 | J | 330 | 374 | 431 | 13 | 0/50 | 0.16 | |
| 11 | K | 340 | 588 | 382 | 10 | 0/50 | 0.20 | |
| 12 | L | 310 | 470 | 589 | 17 | 0/50 | 0.15 | |
| 13 | M | 330 | 427 | 444 | 12 | 0/50 | 0.16 | |
| 14 | N | 355 | 592 | 338 | 9 | 0/50 | 0.18 | |
| 15 | O | 300 | 317 | 571 | 18 | 0/50 | 0.11 | |
| 16 | P | 300 | 311 | 340 | 5 | 0/50 | 0.18 | |
| 17 | Q | 350 | 573 | 442 | 12 | 0/50 | 0.19 | |
| 18 | R | 350 | 519 | 467 | 13 | 0/50 | 0.14 | |
| 19 | S | 340 | 482 | 369 | 7 | 0/50 | 0.16 | |
| 20 | T | 360 | 598 | 566 | 19 | 0/50 | 0.14 | |
| 21 | U | 310 | 336 | 454 | 13 | 0/50 | 0.14 | |
| 22 | V | 310 | 354 | 532 | 17 | 0/50 | 0.16 | |
| 23 | W | 315 | 366 | 377 | 13 | 0/50 | 0.17 | |
| 24 | X | 340 | 488 | 558 | 17 | 0/50 | 0.15 | |

In the field of Comparative Examples, the mark * indicates that the value corresponds to any one of the following conditions.
The number density of MnS is less than 300 (pieces/mm$^2$).
d + 3σ is 20 μm or greater.
One or more false patterns has occurred out of 50 test pieces.
The wear amount of the flank has exceeded 0.20 mm.

TABLE 4

| Test No. | Steel | Average cooling rate of slab (°C./min) | Primary arm spacing of dendrite (μm) | Number density of MnS (pieces/mm$^2$) | d + 3σ (F1) (μm) | Number of occurrence of false pattern (number of occurrence/ total number) | Wear amount of flank (mm) | Remarks |
|---|---|---|---|---|---|---|---|---|
| 25 | A | 85 | 630 | *285 | 18 | 0/50 | *0.32 | Comparative Examples |
| 26 | a | 410 | 622 | *251 | 19 | 0/50 | *0.35 | |
| 27 | b | 420 | 625 | 473 | *34 | *3/50 | 0.18 | |
| 28 | c | 405 | 621 | 320 | *21 | *1/50 | 0.19 | |
| 29 | d | 380 | 615 | *265 | 19 | 0/50 | *0.33 | |
| 30 | e | 330 | 587 | *281 | 14 | 0/50 | *0.24 | |
| 31 | f | 320 | 514 | *261 | 12 | 0/50 | *0.25 | |
| 32 | g | 300 | 479 | 609 | *21 | *3/50 | 0.17 | |
| 33 | h | 320 | 421 | *273 | 11 | 0/50 | *0.21 | |
| 34 | i | 350 | 401 | 501 | 14 | 0/50 | *0.22 | |
| 35 | j | 440 | 341 | 310 | 9 | 0/50 | *0.22 | |
| 36 | k | 190 | 421 | 453 | 13 | 0/50 | *0.23 | |
| 37 | l | 280 | 541 | 441 | 15 | 0/50 | *0.25 | |
| 38 | m | No evaluation performed due to many defects occurred in hot working | | | | | | |
| 39 | n | 420 | 625 | *244 | 16 | 0/50 | *0.35 | |
| 40 | o | 425 | 625 | 404 | *45 | *6/50 | 0.13 | |
| 41 | p | 335 | 605 | *294 | *30 | *4/50 | 0.17 | |
| 42 | q | 360 | 610 | *267 | 19 | 0/50 | *0.25 | |
| 43 | r | 350 | 580 | 610 | *27 | *3/50 | 0.12 | |
| 44 | s | 355 | 592 | *254 | 17 | 0/50 | *0.40 | |
| 45 | t | 330 | 451 | *271 | 13 | 0/50 | *0.26 | |
| 46 | u | 300 | 305 | *278 | 11 | 0/50 | *0.21 | |
| 47 | v | 330 | 421 | 555 | 18 | 0/50 | *0.29 | |
| 48 | w | 300 | 311 | 486 | 10 | 0/50 | *0.22 | |
| 49 | x | 320 | 390 | 537 | 16 | 0/50 | *0.25 | |
| 50 | y | 300 | 323 | 488 | 13 | 0/50 | *0.23 | |

In the field of Comparative Examples, the mark * indicates that the value corresponds to any one of the following conditions.
The number density of MnS is less than 300 (pieces/mm$^2$).
d + 3σ is 20 μm or greater.
One or more false patterns has occurred out of 50 test pieces.
The wear amount of the flank has exceeded 0.20 mm.

Hereinabove, the embodiment of the present invention has been described. However, the embodiment described above is merely an example for executing the present invention. Thus, the present invention is not limited to the embodiment described above, and the embodiment described above can be suitably deformed and executed within the scope not departing from the gist thereof.

INDUSTRIAL APPLICABILITY

According to an aspect of the present invention, it is possible to provide a hot forging steel and a hot forged product which have excellent machinability after hot forging and in which a false pattern is unlikely to be generated at the time of a magnetic particle testing.

The invention claimed is:

1. A hot forging steel comprising, by mass %,

C: more than 0.30% and less than 0.60%,

Si: 0.10% to 0.90%,

Mn: 0.50% to 2.00%,

S: 0.010% to 0.100%,

Cr: 0.01% to 1.00%,

Al: more than 0.005% and 0.100% or less,

N: 0.0030% to 0.0200%,

Bi: more than 0.0001% and 0.0050% or less,

Ti: 0% or more and less than 0.040%,

V: 0% to 0.30%,

Ca: 0% to 0.0040%,

Pb: 0% to 0.40%, and a remainder comprising Fe and impurities, wherein P and O in the impurities are respectively P: 0.050% or less and O: 0.0050% or less, a following Expression (1) is satisfied, and a presence density of MnS having an equivalent circle diameter of smaller than 2.0 μm is 300 pieces/mm$^2$ or more in a cross section parallel to a rolling direction of a steel, $$d+3\sigma<20 \quad (1)$$

where, d in the Expression (1) represents an average equivalent circle diameter of the MnS in an unit of μm having the equivalent circle diameter of 1.0 μm or greater, and σ in the Expression (1) represents a standard deviation of the equivalent circle diameter of the MnS having the equivalent circle diameter of 1.0 μm or greater.

2. The hot forging steel according to claim 1 comprising, by mass %,

Ti: 0.001% or more and less than 0.040%.

3. The hot forging steel according to claim 2 comprising, by mass %,

V: 0.03% to 0.30%.

4. The hot forging steel according to claim 2 comprising, by mass %, one or more selected from the group consisting of Ca: 0.0003% to 0.0040%, and Pb: 0.05% to 0.40%.

5. The hot forging steel according to claim 4 comprising, by mass %,

P: 0.020% or less.

6. The hot forging steel according to claim 3 comprising, by mass %, one or more selected from the group consisting of Ca: 0.0003% to 0.0040%, and Pb: 0.05% to 0.40%.

7. The hot forging steel according to claim 6 comprising, by mass %,

P: 0.020% or less.

8. The hot forging steel according to claim 3 comprising, by mass %,

P: 0.020% or less.

9. The hot forging steel according to claim 2 comprising, by mass %,

P: 0.020% or less.

10. The hot forging steel according to claim 1 comprising, by mass %,

V: 0.03% to 0.30%.

11. The hot forging steel according to claim 10 comprising, by mass %, one or more selected from the group consisting of Ca: 0.0003% to 0.0040%, and Pb: 0.05% to 0.40%.

12. The hot forging steel according to claim 11 comprising, by mass %,

P: 0.020% or less.

13. The hot forging steel according to claim 10 comprising, by mass %,

P: 0.020% or less.

14. The hot forging steel according to claim 1 comprising, by mass %, one or more selected from the group consisting of Ca: 0.0003% to 0.0040%, and Pb: 0.05% to 0.40%.

15. The hot forging steel according to claim 14 comprising, by mass %,

P: 0.020% or less.

16. The hot forging steel according to claim 1 comprising, by mass %,

P: 0.020% or less.

17. The hot forging steel according to claim 1 comprising, by mass %,

Al: more than 0.005% to 0.041%.

18. A hot forged product comprising, by mass %,

C: more than 0.30% and less than 0.60%,

Si: 0.10% to 0.90%,

Mn: 0.50% to 2.00%,

S: 0.010% to 0.100%,

Cr: 0.01% to 1.00%,

Al: more than 0.005% and 0.100% or less,

N: 0.0030% to 0.0200%,

Bi: more than 0.0001% and 0.0050% or less,

Ti: 0% or more and less than 0.040%,

V: 0% to 0.30%,

Ca: 0% to 0.0040%,

Pb: 0% to 0.40%, and a remainder comprising Fe and impurities, wherein P and O in the impurities are respectively P: 0.050% or less and O: 0.0050% or less, a following Expression (2) is satisfied, and a presence density of MnS having an equivalent circle diameter of smaller than 2.0 μm is 300 pieces/$mm^2$ or more in a cross section parallel to a rolling direction of a steel, $$d+3\sigma<20 \quad (2)$$

where, d in Expression (2) represents an average equivalent circle diameter of the MnS in an unit of μm having the equivalent circle diameter of 1.0 μm or greater, and σ in Expression (2) represents a standard deviation of the equivalent circle diameter of the MnS having the equivalent circle diameter of 1.0 μm or greater.

* * * * *